United States Patent [19]

Krumholz

[11] Patent Number: 4,955,748

[45] Date of Patent: Sep. 11, 1990

[54] DUSTLESS DRYWALL FINISHER

[76] Inventor: Robert Krumholz, 138 Park Ave., Garden City Park, N.Y. 11040

[21] Appl. No.: 385,200

[22] Filed: Jul. 26, 1989

[51] Int. Cl.[5] ..... A46B 11/00; B43K 5/00

[52] U.S. Cl. ..... 401/140; 401/205

[58] Field of Search ..... 401/140, 205, 207, 204, 401/203

[56] References Cited

U.S. PATENT DOCUMENTS

| | | | |
|---|---|---|---|
| 775,460 | 11/1904 | Schroyer | 401/140 |
| 1,091,888 | 3/1914 | Lorzing | 401/140 |
| 1,199,646 | 9/1916 | Witherly | 401/140 |
| 1,616,767 | 2/1927 | Stevens | 401/207 |
| 1,714,350 | 5/1929 | De Jong | 401/207 |
| 1,885,997 | 11/1932 | Durham | 401/207 |
| 2,187,670 | 1/1940 | Suddarth | 401/205 |
| 2,557,214 | 6/1951 | Bales | 401/140 |
| 3,080,590 | 3/1963 | Mullinix et al. | 401/140 |
| 3,820,905 | 6/1974 | Sims | 401/140 |
| 4,119,386 | 10/1978 | Cushing | 401/205 |
| 4,822,194 | 4/1989 | Simonette | 401/207 |
| 4,850,728 | 7/1989 | Arroyo | 401/261 |

FOREIGN PATENT DOCUMENTS

| | | | |
|---|---|---|---|
| 2932110 | 2/1981 | Fed. Rep. of Germany | 401/140 |

*Primary Examiner*—Danton D. DeMille

*Attorney, Agent, or Firm*—Michael I. Kroll

[57] ABSTRACT

A dustless drywall finisher, is disclosed. The finisher contains a rigid handle portion containing a liquid, a sponge portion pivotally mounted to the rigid handle portion, and a flexible hollow hose transporting the liquid from the rigid handle portion to the sponge portion so that the sponge portion and the rigid handle portion still remain mutually pivotable with regards to each other and allow the liquid to prevent the formation of airborne dust.

3 Claims, 2 Drawing Sheets

DUSTLESS DRYWALL FINISHER

BACKGROUND OF THE INVENTION

1. Field of the Invention

The present invention relates to a drywall finisher.

More particularly, the present invention relates to a drywall finisher that is dustless.

2. Description of the Prior Art

Finishing devices are known in the art. One such drywall finisher is disclosed, for example, in the U.S. Pat. No. 2,037,349 to Svetlik.

The U.S. patent to Svetlik relates to a wax apparatus that has a forked stick part in which a wax container is exchangeably arranged.

The U.S. patent to Svetlik teaches a pivoting support piece located between the fork-arms of the forked stick part. Means for securing releasably the one end of the wax container on the supporting piece is provided. Means for fastening the wax container in a position parallel to the fork-arms is provided. In consequence of the supporting piece being swingable, the wax container is inserted into the supporting piece from the side, at an angle to the forkarms so that the exchanging and fastening of the wax container may be effected.

Another such finishing device is disclosed, for example, in the U.S. Pat. No. 2,228,573 to Lowe.

The U. S. patent to Lowe relates to fountain liquid applicators.

The U.S. patent to Lowe teaches a handle adapted to have a spreader head applied to the lower end. A container is provided on the handle that has a discharge opening. A valve normally closing the discharge opening is provided, a spring seating the valve, an operating rod extending along the handle and connected at its lower end with the valve, means on the rod for manipulating the same to cause opening of the valve, and means associated with the rod is operable to lock the valve on its seat.

Another such finishing device is disclosed, for example, in the U.S. Pat. No. 2,470,837 to Polson.

The U.S. Pat. No. 2,470,837 to Polson relates to a wax spreader equipped with valved wax-dispensing means whereby the wax may be applied when and as required to the floor and spread thereon while grasping a single handle.

The U.S. Pat. No. 2,470,837 to Polson teaches a spreader head formed from a block of material having a removable cover. A rigid handle bar fitted to the block for disposition at a forward inclination thereto and having an outer curved horn-like grip, a pair of spaced loop-like bands secured to the bar to extend outwardly and upwardly from its axis, a reservoir held by the hands, a single discharge tube leading from the reservoir in bridging relation to the block and having plural outlet nozzles dipped forwardly of the latter at determined points thereto for dispensing fluid is advance of the block onto a foundation, a plug valve fitting the tube aft of the nozzles and having a tuning crank extended beneath the bar, a throw lever pivotally attached to the bar next to its grip and beneath the latter, an operating link wholly outside of the bar pivoted to the lever and the crank, and tensioning means active on the crank to normally maintain the valve in it's closing position.

Another such finishing device is disclosed, for example, in the U.S. Pat. No. 3,126,573 to Vosbikian.

The U.S. Pat. No. 3,126,573 to Vosbikian relates to a cleaning device for applying wax and polishing material to a floor.

Another such finishing device is disclosed, for example, in the U.S. Pat. No. 4,802,782 to Scalf.

The U.S. Pat. No. 4,802,782 to Scalf relates to an instrument intended to remove spots or stains in a localized area.

The U.S. Pat. No. 4,802,782 to Scalf teaches a tool designed to clean and remove stains, spots, or concentrated areas of dirt from a carpet, rug or a normally soft material surface by means of agitating the localized area, applying a cleaning liquid thereto, and then absorbing or blotting up excess liquid as well as the dirt or staining material from the carpet surface.

Numerous innovations for finishing devices have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a dustless drywall finisher which avoids the disadvantages of the prior art.

More particularly, it is an object of the present invention that the dustless drywall finisher of the present invention is safe and easy to use. Because it is dustless, there is no mess to clean up. Additionally, the present invention is light weight and, all of the parts are easily replaceable. The present invention uses gravity to create fluid flow. This fluid flow creates a vapor lock to prevent the over saturation of the sponge while eliminating waste.

The present invention is dustless and carries its own liquid (water). The water is metered at discharge from the handle via a valve. The water then passes through an "L"-fitting and into a perforated tube mounted within the sponge.

The perforated tube in the sponge allows the water to enter the sponge and render it wet. Wetness is dependent upon the position of the valve. As the present invention is used, the dust generated is dissolved in the sponge water which is easily rinsed out.

The present invention has as its primary function finishing drywall. However, the present invention may also be used to finish floors, walls, window frames and mullions, and siding and wood paneling, etc., to name a few.

In keeping with these objects, and with others which will become apparent hereinafter, one feature of the present invention resides, briefly stated, in a dustless drywall finisher, having a rigid handle portion containing a liquid, a sponge portion pivotally mounted to the rigid handle portion wherein means for transporting the liquid from the rigid handle portion to the sponge portion is provided.

When the dustless drywall finisher is designed in accordance with the present invention, the sponge portion and the rigid handle portion remain mutually pivotable with regards to each other, and uses the liquid to prevent the formation of airborn dust.

In accordance with another feature of the present invention, the rigid handle portion has a free end, is hollow, and contains a cap at the free end.

Another feature of the present invention is that the liquid is water.

Yet another feature of the present invention is that the means include a hollow flexible tube.

Still another feature of the present invention is that the cap is made of rubber.

Yet still another feature of the present invention is that the rigid handle portion contains a rigid tube that is made of aluminum so that the rigid handle portion will not oxidize.

Still yet another feature of the present invention is that the rigid handle portion has a fixed end on which a plug is mounted.

Another feature of the present invention is that the plug is made of plastic.

Yet another feature of the present invention is that the rigid handle portion contains a rigidly affixed internal valve.

Still another feature of the present invention is that the rigid handle portion has an intermediate position at which the valve is internally attached.

Yet still another feature of the present invention is that the flexible tube has a first end and a second end, the first end is connected to an "L"-fitting disposed on the sponge portion while the second end is connected to the valve so that when the valve is opened the fluid will pass from the rigid tube of the rigid handle portion through the valve, through the flexible tube and into the "L"-fitting of the sponge portion.

Still yet another feature of the present invention is that the plug consists of a body that is substantially cylindrical in shape and contains a pair of extensions emanating from the body and each extension has a hole.

Another feature of the present invention is that the pair of bolts, respectively, pass through each of the holes in the pair of extensions.

Yet another feature of the present invention is that it further includes a "tee" fitting containing a transverse arm and a longitudinal arm The "tee" fitting pivotally connects the handle portion to the sponge portion by having the longitudinal arm pass between the pair of extensions so that by tightening down the bolts on the longitudinal arm, the handle portion is kept in position.

Still another feature of the present invention is that the transverse arm is pivotally attached to the platform head by a pair of raised openings.

Yet still another feature of the present invention is that it further includes a perforated tube disposed longitudinally within the sponge portion and has a first end connected to the "L" fitting and a second end being capped.

In keeping with these objects, and with others which will become apparent hereinafter, another feature of the present invention resides, briefly stated, in a method of using a dustless drywall finisher, including the steps of removing the rubber cap from the free end of the handle, opening the valve disposed on the handle, filling the handle with desired liquid, applying pressure to the sponge to initiate flow of the liquid, replacing the rubber cap on to the free end of the handle, and rubbing the sponge over the desired area.

When the dustless drywall finisher is designed in accordance with the present invention, airborn dust is eliminated.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

LIST OF REFERENCE NUMERALS UTILIZED IN THE DRAWING

Figure 6:
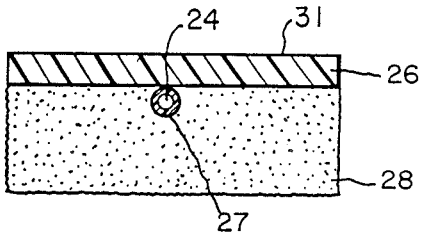
FIG. 6 is a cross-sectional view of the present invention taken along line 6—6 in FIG. 1.

10—dustless drywall finisher of the present invention
11—another end of the tube 14 of the handle portion 13
12—cap of the handle portion 13 of the dustless drywall finisher of the present invention
13—handle portion of the dustless drywall finisher of the present invention
14—hollow tube of the handle portion 13 of the dustless drywall finisher of the present invention
15—sponge portion of the dustless drywall finisher of the present invention
16—plug of the handle portion 13 of the dustless drywall finisher of the present invention
17—fluid content in the tube 14 of the handle portion 13
18—valve of the handle portion 13 of the dustless drywall finisher of the present invention
19—end of the tube 14 of the handle portion 13
21—female threads on the end 19 of the tube 14
22—"L" fitting of the sponge portion 15
23—end of the perforated pipe 24 of the sponge portion 15
24—perforated pipe of the sponge portion 15
25—longitudinal axis of the sponge portion 15
26—platform head of the sponge portion 15
27—interior of the sponge 28
28—sponge of the sponge portion 15
29—other end of the perforated pipe 24 of the sponge portion 15
30—pressure cap of the perforated pipe 24 of the sponge portion 15
31—upper face of the platform head 26 of the sponge portion 15
32—bolts of the plug 16
33—extension of the body 35 of the plug 16 of the dustless drywall finisher of the present invention
34—adhesive layer of the sponge portion 15
35—body of the plug 16 of the dustless drywall finisher of the present invention
36—a bolt to mount the valve 18 to the tube 14
37—another extension of the body 35 of the plug 16 of the dustless drywall finisher of the present invention
38—another bolt to mount the valve 18 to the tube 14
40—"Tee" for pivotally connecting the handle portion 13 to the sponge portion 15
41—hollow tube for carrying the fluid 17 from the handle portion 13 to the sponge portion 15

42—transverse arm of the "Tee" 40
43—raised opening in the platform head 26
44—longitudinal arm of the "Tee" 40
45—another raised opening in the platform head 26
46—end of the hollow tube 41
47—another end of the hollow tube 41
48—male threads on the cap 12 of the dustless drywall finisher of the present invention
49—rectangular solid of the sponge portion 15
50—hole for the bolt 32 of the plug 16
51—another hole for the bolt 32 of the plug 16
52—rigid aluminum tube contained within the rigid handle portion 14

DETAILED DESCRIPTION OF THE PREFERRED EMBODIMENT

Figure 1:
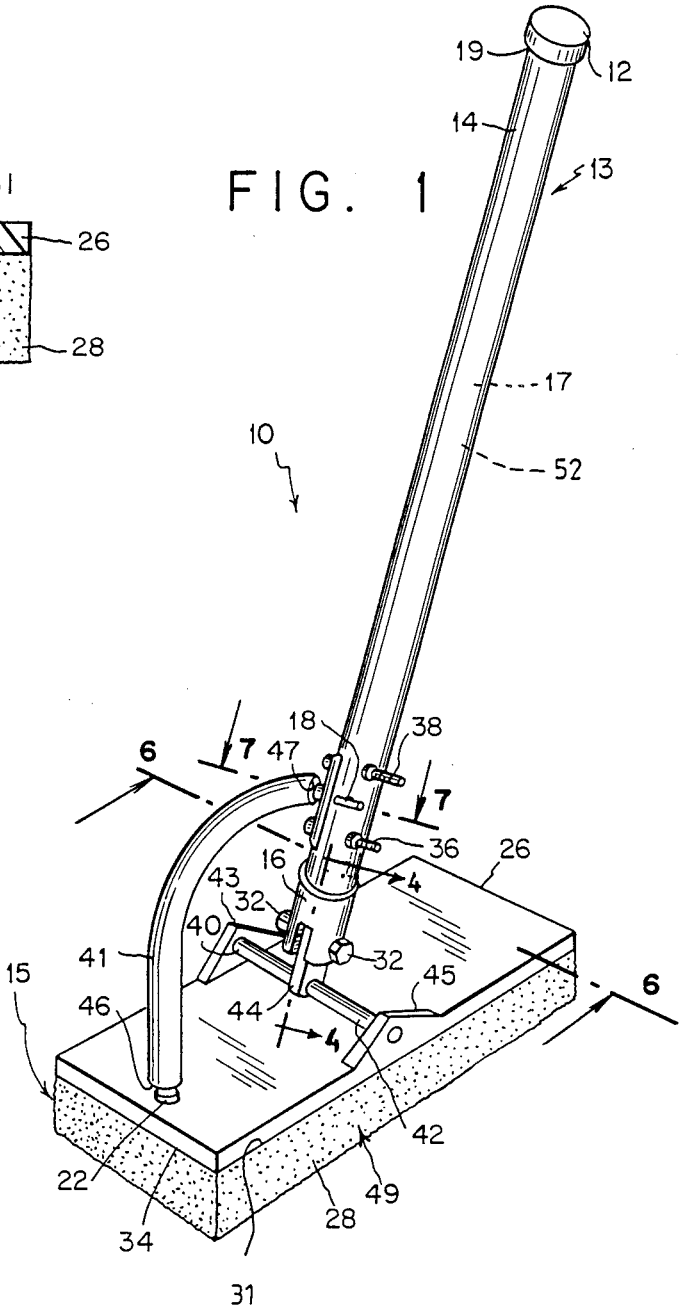
FIG. 1 is a perspective view of the dustless drywall finisher of the present invention.
Figures 2, 3:
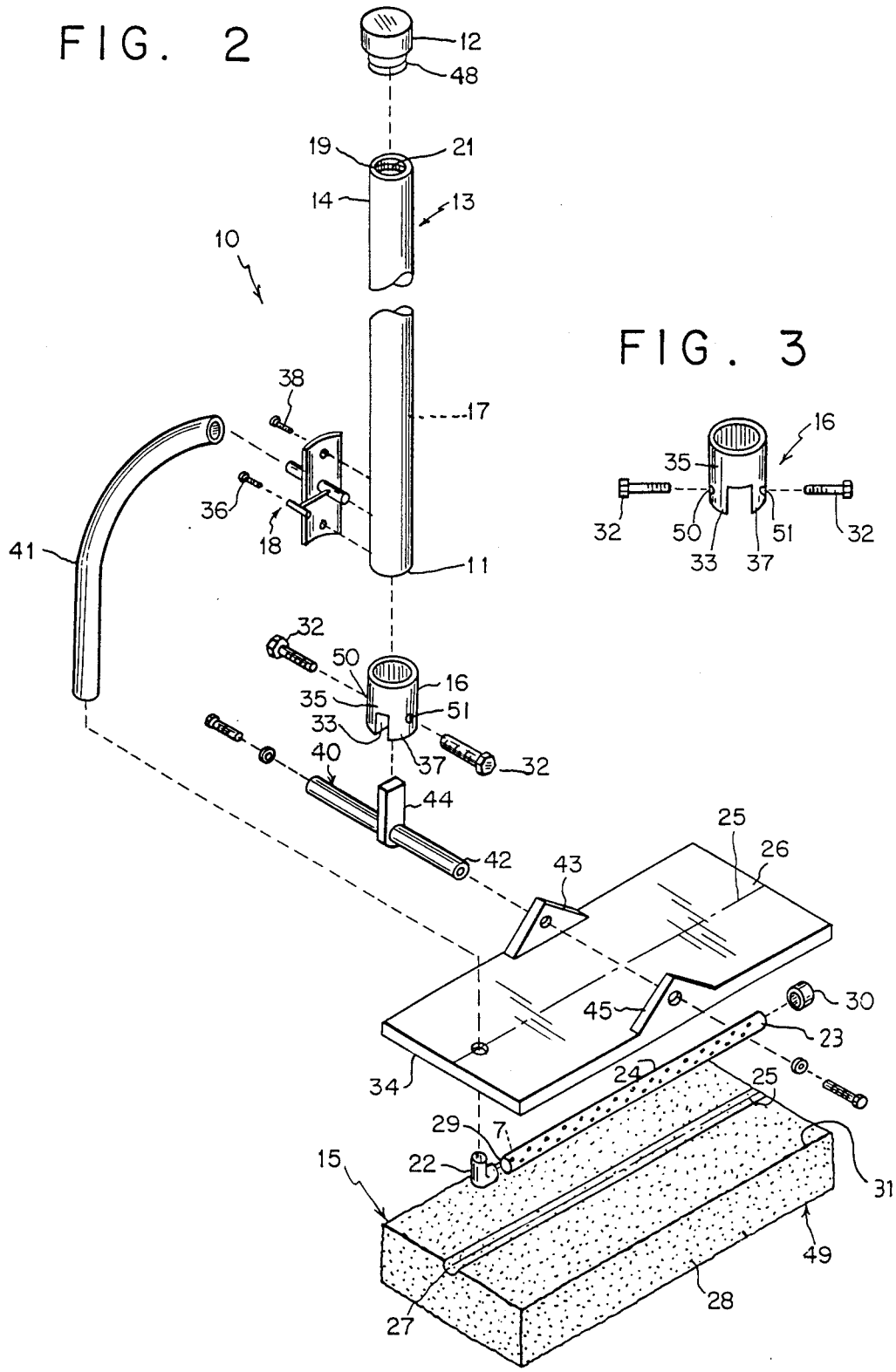
FIG. 2 is an exploded perspective view of the dustless drywall finisher of the present invention, shown in FIG. 1.
FIG. 3 is a perspective view of the combination plastic plug and bolt arrangement.

Referring not to FIGS. 1 and 2, the dustless drywall finisher of the present invention is shown generally at 10 and contains a handle portion 13 and a sponge portion 15.

The handle portion 13 contains: cap 12 which may be rubber, but is not limited to it, hollow tube 14 containing a rigid aluminum tube 52, but is not limited to it, plug 16 which may be plastic, but is not limited to it, valve 18, "L"-fitting 22, perforated pipe 24, longitudinal axis 25, platform head 26, interior 27 of the sponge 28, rectangular solid 49, pressure cap 30, upper face 31 of the sponge 28, bolts 32, adhesive layer 34, bolt 36, bolt 38, tee 40, transverse arm 42, and longitudinal arm 44.

In the sponge portion 15, as shown in FIG. 1, the sponge 28 is substantially the shape of the rectangular solid 49. The platform head 26 rests on the upper face 31 of the sponge portion 15. The platform head 26 is attached to the sponge 28 by the adhesive layer 34.

The perforated pipe 24 runs substantially the length of the longitudinal axis 25 of the sponge portion 15 and is disposed below the platform head 26, in the interior 27 of the sponge 28.

Figure 5:
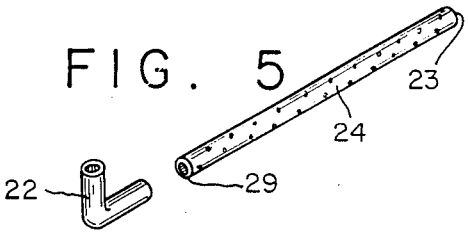
FIG. 5 is a perspective view of the "L" fitting attached to the perforated pipe.

Connected to the end 29 of the perforated pipe 24 is the "L" fitting 22 as shown in FIG. 5. The pressure cap 30 is connected to the other end 23 of th perforated pipe 24.

The handle portion 13 contains a hollow tube 14 so that the fluid contents 17 may be stored and/or dispensed therefrom. One end 19 of the hollow tube 14 contains female threads 21 so that the male theads 48 of the cap 12 may mate and yet be threadably removable. The cap 12 is removed when the tube 14 empties and requires refilling.

Figure 7:
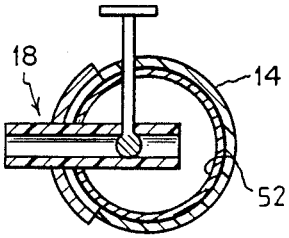
FIG. 7 is a cross-sectional view of the present invention taken along line 7—7 in FIG. 1.

The valve 18 is located in the tube 14, as shown in FIG. 7. The valve 18, mounted internally to the tube 14 by bolt 36 and bolt 38, regulates the amount of fluid 17 passing therefrom.

The hollow tube 41 is connected at the end 46 to the "L"-fitting 22 and at the end 47 to the valve 18 so that when the valve 18 is opened, the fluid 17 will pass from the hollow tube 14, through the valve 18, through the hollow tube 41, and finally enter the sponge 28, via the "L"-fitting 22.

Figure 4:
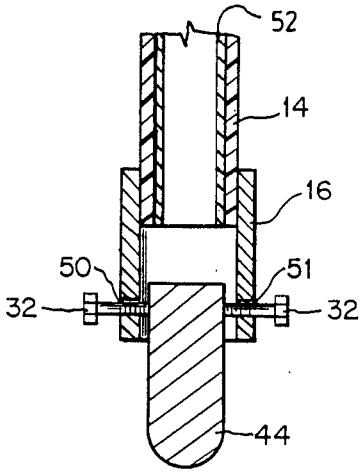
FIG. 4 is a cross-sectional view of the combination plastic plug and bolt arrangement taken along line 4—4 in FIG. 1.

Located at the other end 11 of the hollow tube 14 is the plug 16 which may be made of plastic, but is not limited to it, shown in FIGS. 3 and 4. The plastic plug 16 consists of a body 35 which is substantially cylindrical in shape and fits over the end 11 of the hollow tube 14. The plug 16 contains an extension 33 and another extension 37. The bolt 32 passes adjustably through a hole 50 in the extension 33 while another bolt 32 passes adjustably through a hole 51 in the extension 37.

The tee 40 pivotally connects the handle portion 13 to the sponge portion 15. The tee 40 includes the transverse arm 42 and the longitudinal arm 44.

The longitudinal arm 44 passes between the extension 33 and the extension 37 of the plug 16. The bolts 32 tighten down on the longitudinal arm 44 and hold it in position. The transverse arm 42 is pivotally attached to the platform head 26 by a raised opening 43 and another raised opening 45.

The present invention 10 is dustless and carries its own fluid (water) 17. The water is metered at discharge from the handle 13 via a valve 18. The water then passes through an "L"-fitting 22 and into a perforated tube 24 mounted within the sponge 15.

The perforated tube 24 in the sponge 15 allows the fluid 17 to enter the sponge 15 and render it wet. Wetness is dependent upon the position of the valve 18. As the present invention 10 is used, the dust generated is dissolved in the sponge water which is easily rinsed out.

It will be understood that each of the elements described above, or two or more together, may also find a useful application in other types of constructions differing from the type described above.

While the invention has been illustrated and described as embodied in a dustless drywall finisher, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A dustless drywall finisher, comprising:

(a) a rigid handle portion containing a liquid, a hollow free end, a fixed end, a plastic plug, and a rubber cap disposed at said free end, said liquid being water, and said rigid handle portion having said plug mounted to said fixed end of said rigid handle portion, said plug consisting of a body being substantially cylindrical in shape and containing a pair of extensions emanating therefrom, said pair of extensions containing a pair of diametrically opposed holes containing a pair of bolts, respectively, said rigid handle portion containing a rigidly affixed internal valve, said internal valve being internally attached within said rigid handle portion;

(b) a sponge portion support on a platform head is pivotally mounted to said rigid handle portion and said rigid handle portion contains a rigid tube that is made of aluminum so that said rigid handle portion will not oxidize;

(c) means for transporting said liquid from said rigid handle portion to said sponge portion so that said sponge portion and said rigid handle portion still remain mututally pivotable with regards to each other and allows said liquid to prevent the formation of airborn dust, said means including a hollow flexible tube that has a first end and a second end, said first end being connected to an "L"-fitting disposed on said sponge portion while said second end is connected to said valve so that when said valve is opened said fluid will pass from said rigid tube of said rigid handle portion through said valve, through said flexible tube, and into said "L"-fitting of said sponge portion; and (d) a "tee" fitting containing a transverse arm and a longitudinal arm which pivotally connects said handle portion to said sponge portion by having said longitudinal arm pass between said pair of extensions and said bolts tightening dowon on said longitudinal arm and holding it in position.

2. A finisher as defined in claim 1, wherein said transverse arm is pivotally attached to said platform head by a pair of raised openings.

3. A finisher as defined in claim 2, further comprising a perforated tube disposed longitudinally within said sponge portion and having a first and end connected to said "L" fitting and a second end being capped.

* * * * *